US011639008B2

(12) United States Patent
Jackman

(10) Patent No.: US 11,639,008 B2
(45) Date of Patent: May 2, 2023

(54) METHOD AND APPARATUS FOR CUTTING FOOD INTO UNIQUE GEOMETRIC PORTIONS

(71) Applicant: High Liner Foods Incorporated, Portsmouth, NH (US)

(72) Inventor: James Jackman, Portsmouth, NH (US)

(73) Assignee: High Liner Foods Incorporated

( * ) Notice: Subject to any disclaimer, the term of this patent is extended or adjusted under 35 U.S.C. 154(b) by 0 days.

(21) Appl. No.: 17/086,168

(22) Filed: Oct. 30, 2020

(65) Prior Publication Data

US 2021/0213635 A1 Jul. 15, 2021

Related U.S. Application Data

(60) Provisional application No. 62/949,132, filed on Dec. 17, 2019.

(51) Int. Cl.
*B26D 3/00* (2006.01)
*B26D 1/12* (2006.01)

(52) U.S. Cl.
CPC ..... *B26D 3/00* (2013.01); *B26D 1/12* (2013.01); *B26D 2210/02* (2013.01)

(58) Field of Classification Search
CPC ..... B26D 3/00; B26D 1/12; B26D 2210/02
See application file for complete search history.

(56) References Cited

U.S. PATENT DOCUMENTS

| | | | | |
|---|---|---|---|---|
| 2,915,992 | A * | 12/1959 | Gilmore | A21C 11/163 425/97 |
| 4,405,186 | A * | 9/1983 | Sandberg | B26D 7/32 414/790 |
| 6,407,818 | B1 * | 6/2002 | Whitehouse | G01B 11/00 356/627 |
| 10,850,416 | B2 * | 12/2020 | Schmeiser | B26D 7/0608 |
| 2002/0166429 | A1 * | 11/2002 | Pryor | B26D 3/18 83/77 |
| 2016/0339597 | A1 * | 11/2016 | Lischinski | B26D 7/1845 |
| 2017/0113368 | A1 * | 4/2017 | Schmeiser | B26D 7/01 |
| 2018/0169888 | A1 * | 6/2018 | Weber | B26D 7/0616 |
| 2019/0232513 | A1 * | 8/2019 | Erné | B26D 7/32 |
| 2020/0276724 | A1 * | 9/2020 | Donaghy | B26D 3/26 |
| 2021/0219557 | A1 * | 7/2021 | Van Blokland | B26D 1/141 |
| 2021/0323186 | A1 * | 10/2021 | Hartmann | B26D 7/01 |

* cited by examiner

*Primary Examiner* — Sean M Michalski
(74) *Attorney, Agent, or Firm* — Ridout & Maybee LLP

(57) ABSTRACT

An apparatus and method for cutting blocks of frozen food into irregular shapes comprises a slicer unit carrying a cutting blade and chutes for feeding logs of frozen food to said blade. The chute extends from a chute inlet to a chute outlet, having a central longitudinal axis extending from the center of the chute inlet to center of chute outlet. The cutting blade is positioned below the chute outlets wherein said elongate blocks of processed food are fed into said chute inlet through the chute to the chute outlet, to said blade, said blade sectioning the blocks into smaller pieces. The chutes are angled greater than 15 degrees and less than 90 degrees from the plane of the cutting blade and the chute is rotated about its longitudinal axis between 0 to 180 degrees from a square orientation to the plane of the blade.

16 Claims, 9 Drawing Sheets

METHOD AND APPARATUS FOR CUTTING FOOD INTO UNIQUE GEOMETRIC PORTIONS

CROSS-REFERENCE TO RELATED APPLICATION

This application claims the benefits of priority to U.S. Provisional Patent Application No. 62/949,132, filed Dec. 17, 2019, titled METHOD FOR CUTTING FROZEN FISH, the contents of which are hereby expressly incorporated into the present application by reference in their entirety.

BACKGROUND ON THE INVENTION

Field of the Invention

The present invention relates generally to food products, and more particularly to an apparatus and method of dividing frozen processed meat, fish and/or seafood into portions with unique geometry.

Description of the Prior Art

Processed frozen food such as fish and seafood is commonly formed by feeding frozen blocks into slicing machines from a vertical or near vertical chute or chutes to a horizontal cutting blade (see FIG. 1 for an example). Such known methods and apparatus for preparing processed frozen food meat, seafood and fish product typically create uniform thickness slices like squares, rectangles and diamonds for the product pieces. For example, fish sticks are formed by feeding the rectangular logs of frozen processed fish to the slicing blade, which a rectangular block to create the rectangular fish stick portion. A conveyor below the blade carries the cut portions for further value added processing, such as battering, breading, glazing and packaging.

Known processed food cutting machines are designed to create industry standard cut patterns of uniform thickness, such as squares and rectangles but never anything as unique as 6 sided beveled pieces, creating variable thickness, such as "natural chicken wing" shape. Having multisided or beveled sided cut pieces such as pieces that emulate chicken wing shape is desirable as they are easily held, and have a shape that is conducive to dip-ability, crispiness of edges and tenderness of the product. The variable thickness creates a variable eating texture and moisture profile.

SUMMARY OF INVENTION

It is an object of the present invention to provide an improved apparatus and method of processing frozen food materials which allows for the creation of multi sided pieces of consumable processed food, such as fish or seafood and for example emulating shape of chicken wings pieces. In accordance with an aspect of the invention, there is provided an apparatus for cutting blocks of frozen processed food into irregular shapes comprising a slicer unit carrying a fixed cutting blade and at least one chute for feeding slabs/logs of said frozen processed food to said blade, said chute defining a chute path for said logs/slabs extending from a chute inlet to a chute outlet, having a central longitudinal axis extending from the center of the chute inlet to center of chute outlet. The cutting blade is positioned below the at least one chute outlet. The elongate blocks of processed food are fed into said chute inlet through the chute to the chute outlet, presented to the blade, with the blade dividing the slabs into smaller portions. The at least one chute is angled greater than 30 degrees and less than 80 degrees from the plane of the cutting blade. The at least one chute is rotated about its longitudinal axis between 0 to 180 degrees and preferably between 20 and 80 degrees from a square orientation to the plane of the blade. The slicer unit may include height adjustment attachments for raising the unit at at least 2 corners thereof. In accordance with an aspect of the invention, the height adjustment attachment is a frame with adjustable castors, raises the unit at a chute inlet side of the unit such that the blade is raised to an angle of at least 18 degrees to the horizontal. In accordance with a further aspect of the invention, the chute inlet side of the unit is raised by approximately 18 degrees position the chute approximately 45 degrees to horizontal ground. As will be discussed below, the opposite side of the unit may be raise with chute orientation altered.

In accordance with a further aspect of the invention, there is provided a method of cutting blocks of food, such as frozen processed seafood of fish, into irregular shapes comprising feeding logs of said food via at least one chute to a horizontally oriented cutting blade; said chute defining a chute path for said logs extending from a chute inlet to a chute outlet, having a central longitudinal axis extending from the center of the chute inlet to center of chute outlet; Said cutting blade positioned below the at least one chute outlet; wherein said logs of food are fed into said chute inlet through the chute to the chute outlet, to said blade, said blade sectioning the blocks into smaller pieces. In accordance with a further aspect of the invention, the at least one chute angled greater than 15 degrees and less than 90 degrees from the plane of the cutting blade and the at least one chute axially rotated about its longitudinal axis between 180 to 0 degrees from a square orientation to the plane of the blade. The at least one chute may be angled at 32 degrees to the plane of the cutting blade. A piece of food such as frozen fish or seafood, produced by the method or apparatus described herein forms an aspect of the invention.

An example slicer which could be utilized with the herein invention is the Ross Orbital Slicer 950-04. It should be understood that any suitable slicer known in the industry could be used. Typical orbital slicers are required to be supported on a level floor per manufacturers operational specifications. The Ross specification and instruction manual stating "operational area of slicing blade must have a floor that is level and free of obstruction".

Altering the angle of a slicer on a floor to raise the chute angle is not obvious to anyone with ordinary knowledge of food manufacturing. It is not part of the standard operating procedure for use of standard known industrial slicers. Using such machines to cut processed frozen food into 6 sided and/or beveled and/or chicken wing shapes was not an option using traditional methods. The herein invention allow production of a 6 angled frozen processed food (such as fish or seafood) shape in a commercially viable way, rather than hand cutting.

DETAILED DESCRIPTION OF EXAMPLE EMBODIMENTS OF THE INVENTION

Figure 1:
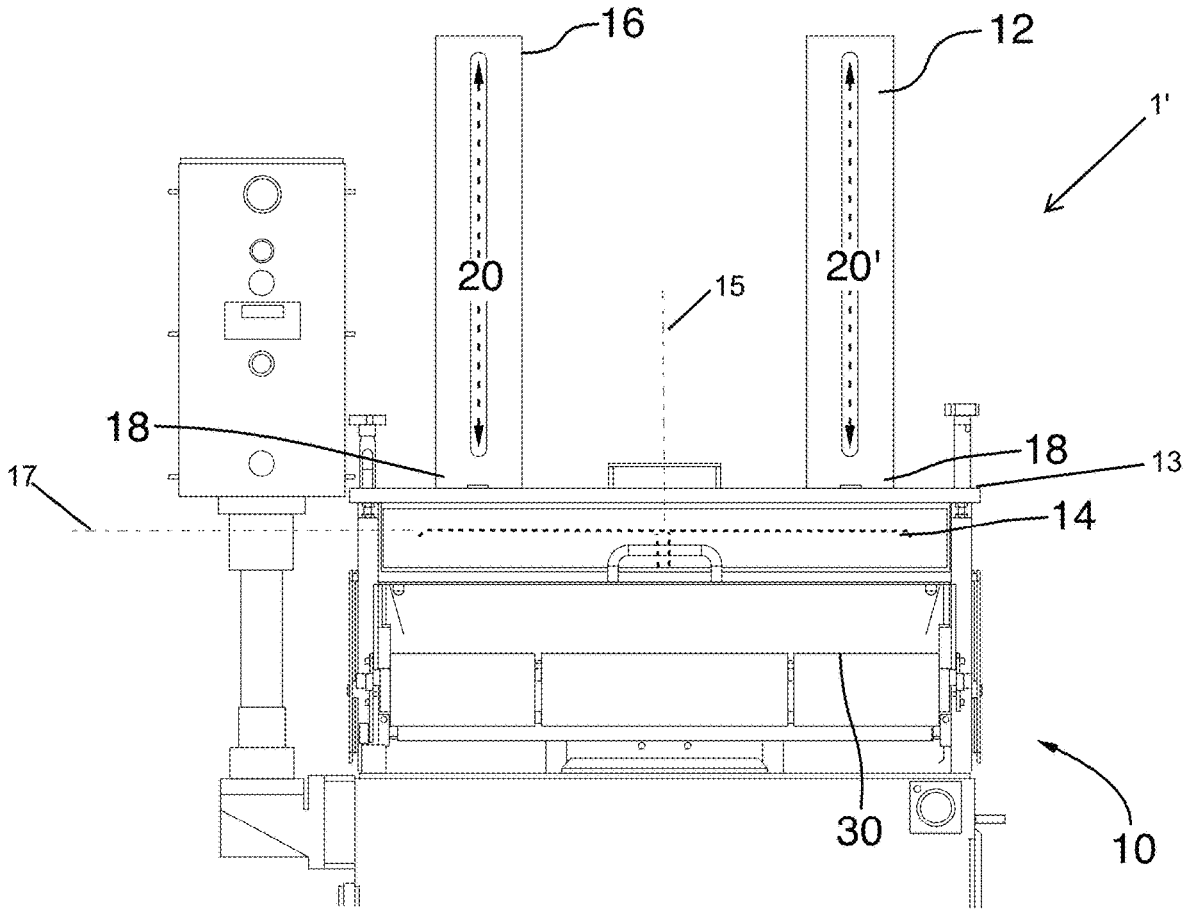
FIG. 1 is side view of a known orbital slicer for frozen processed meat.
Figure 1A:
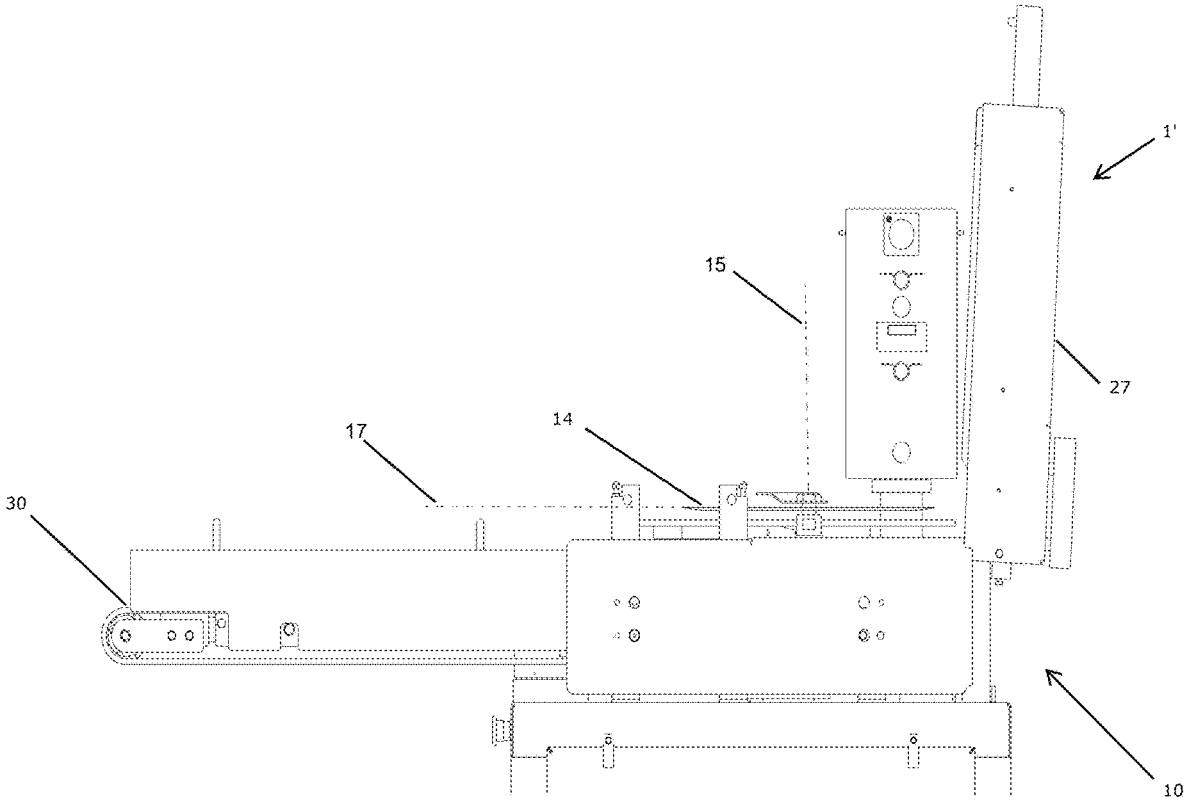
FIG. 1A is a side view of the known orbital slicer of FIG. 1 in an open position.
Figure 7:
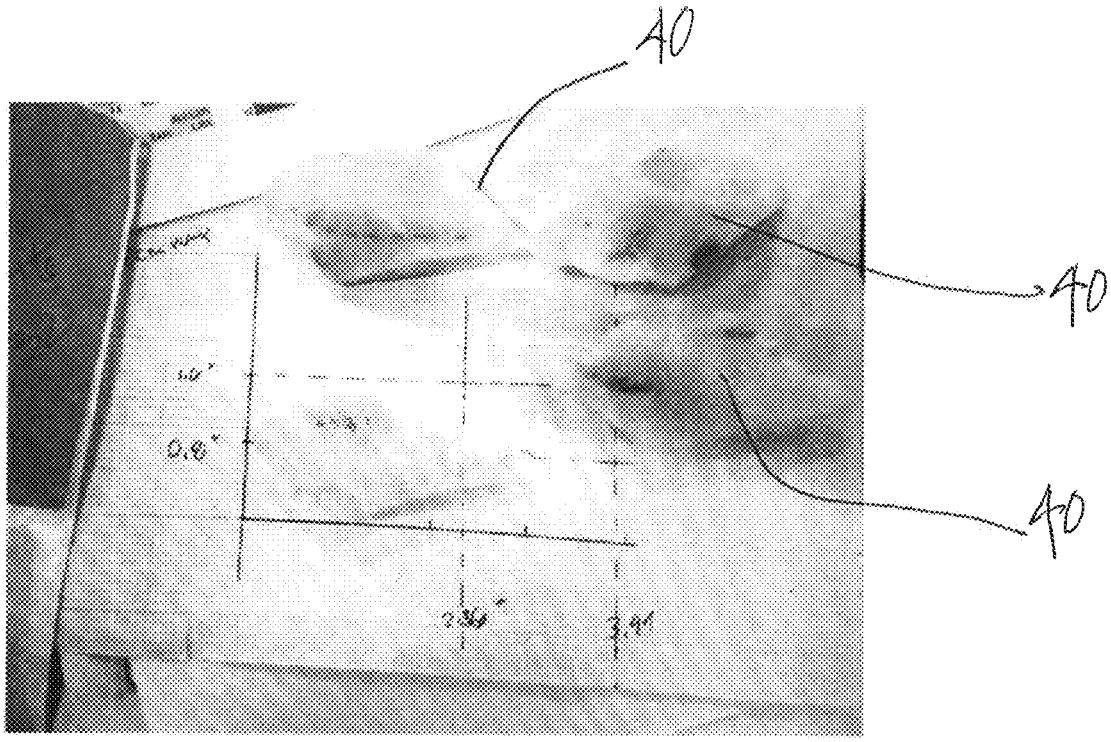
FIGS. 7 and 8 are illustrations of example pieces of processed food cut by the apparatus of the invention.
Figure 8:
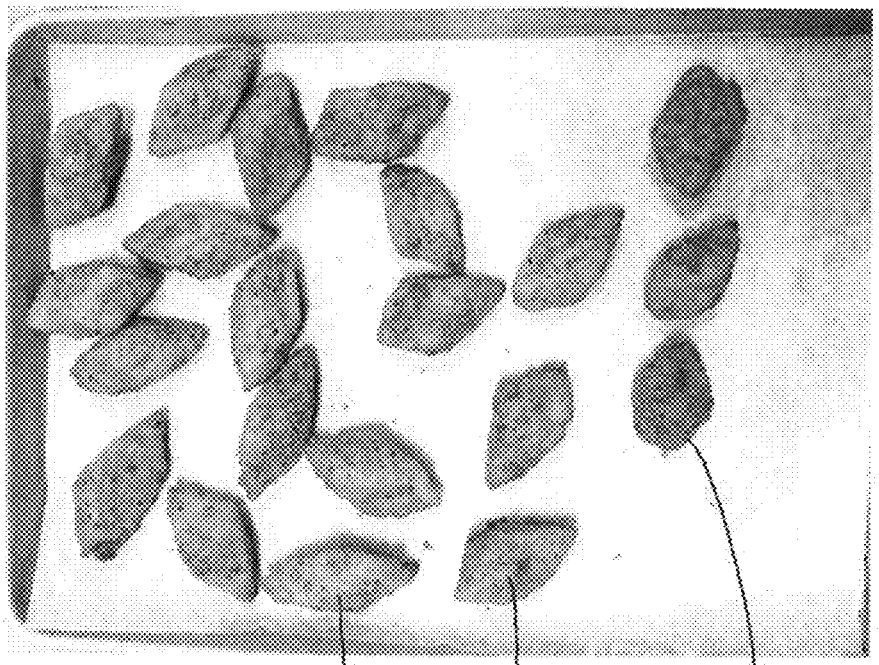

Traditional fish sticks and rectangular fish burgers are cut using vertical chutes to create uniform thickness portions from processed food slabs (also referred to as logs). The present invention relates to a method and apparatus for making a frozen process food product, preferably fish and seafood that has non uniform thickness and produces non rectangular shapes from standard rectangular slabs or logs, such as a 6 sided shape. An example of such shape is the general dimensional appearance of a chicken wing in terms of non rectangular sides and angles such as are shown in FIGS. 7 and 8. In the present invention, an apparatus comprises a fish slicer apparatus (1) having the general configuration of the prior art apparatus (1') illustrated in FIG. 1 (and FIG. 1A). In this respect, the fish slicer apparatus (1) according to the present invention (see for instance FIGS. 1 and 1A and FIGS. 5 and 5A) includes intake chutes (12) disposed above a fixed plane (13) defined by the slicer unit (10) of the apparatus (1) beneath which a slicer blade (14) is located and operates. The slicer blade (14) is mounted within the slicer unit (10) that forms part of the apparatus (1), the slicer blade (14) being configured to rotate about a fixed axis (15), in accordance with the configuration of known orbital slicers. The slicer blade (14) thereby rotates in a slicing plane or cutting blade plane (17). Below the slicer blade (14) is a conveyor (30) to take cut pieces away for further processing or packaging. In the prior art apparatus (1') illustrated in FIGS. 1 and 1A, the intake chutes (12) are arranged vertically relative to the horizontally arranged orbital slicing blade (14) such that the longitudinal axis (20) of the chute (12) extends 90 degrees, or normal to, the horizontal slicing plane (17) of the cutting blade (14) and where the apparatus (1) is arranged such that the slicing plane (17) is parallel to the floor on which the apparatus (1) is arranged. The cutting blade (14) is further illustrated in the prior art configuration of a known orbital slicer in FIG. 1A with the chutes (12) removed for ease of illustration and the slicer unit (10) disposed in an open position. As will be described in further detail below, in the present invention, the apparatus (1) is configured such that the chutes (12) are arranged relative to the slicer unit (10), and, in some instances, the slicer unit (10) is arranged such that the slicer blade (14) is disposed at an angle relative to the horizontal floor to provide an apparatus (1) that can create pieces (30) of frozen processed food such as fish or seafood with non rectangular angles and/or with beveled cut angles to emulate chicken wings or the like.

Figure 5:
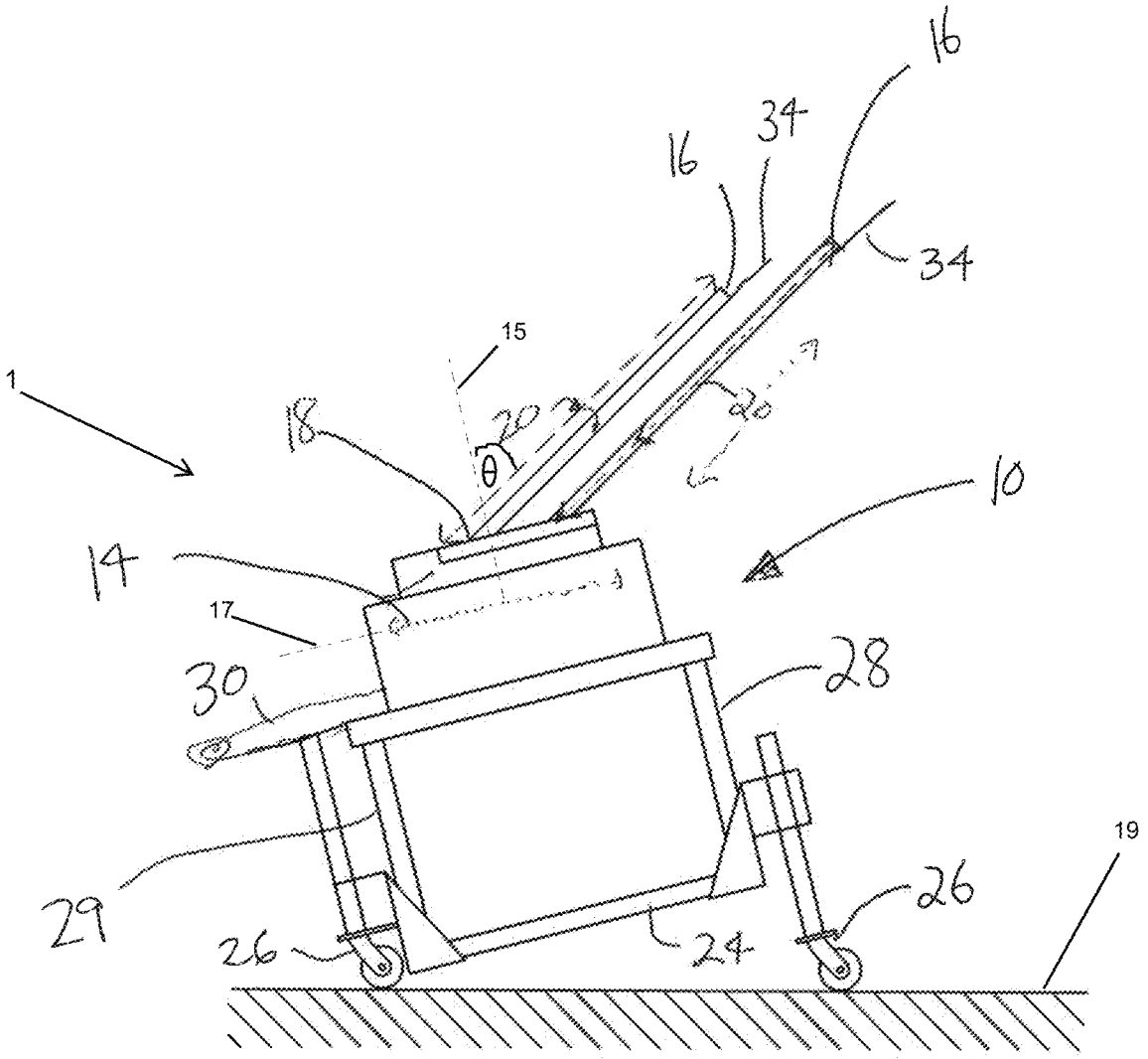
FIG. 5 is a side view of a slicer unit, with angled chutes and height adjustment attachments elevating chute inlet end of unit in accordance with an aspect of the invention.
Figure 5A:
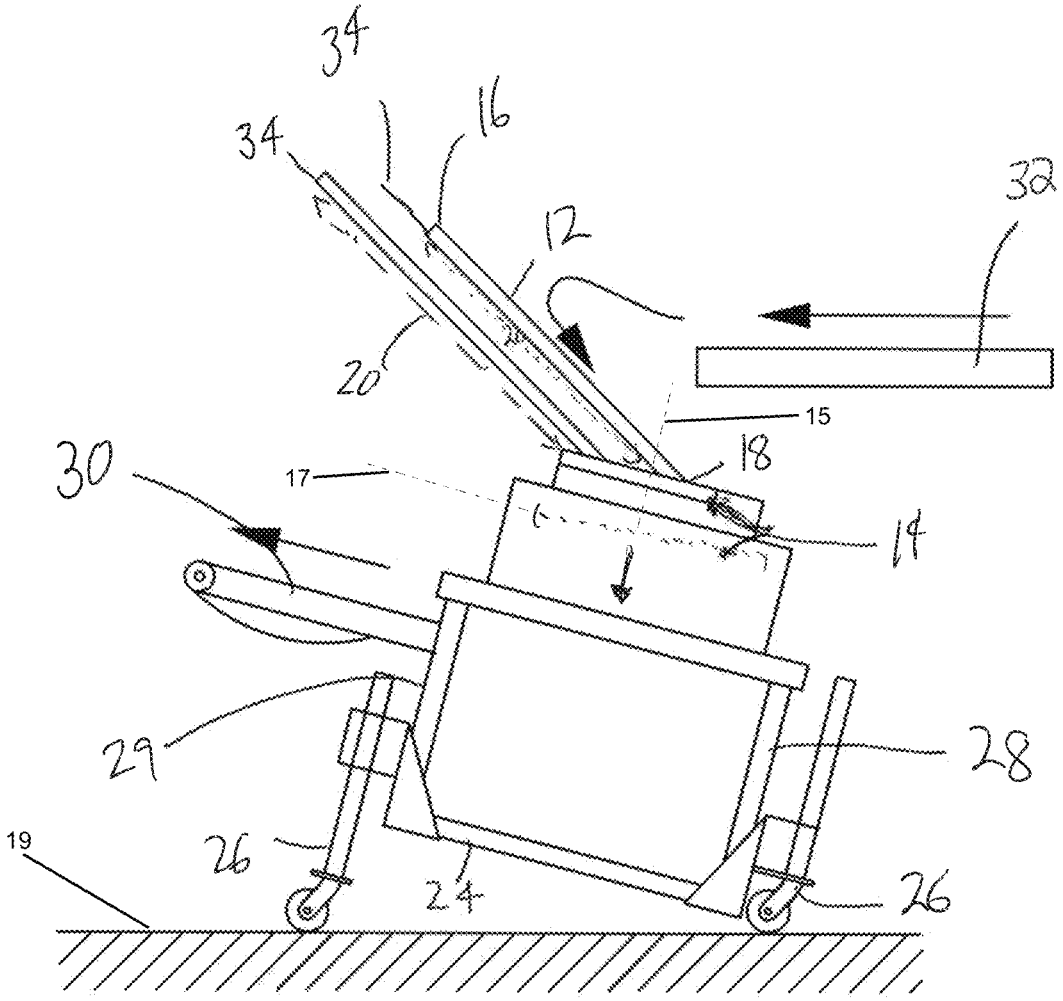
FIG. 5*a* is a side view of the a slicer unit with angled chutes and height adjustment attachments elevating the chute outlet end of the unit with chutes repositioned, in accordance with an aspect of the invention.
Figure 6:
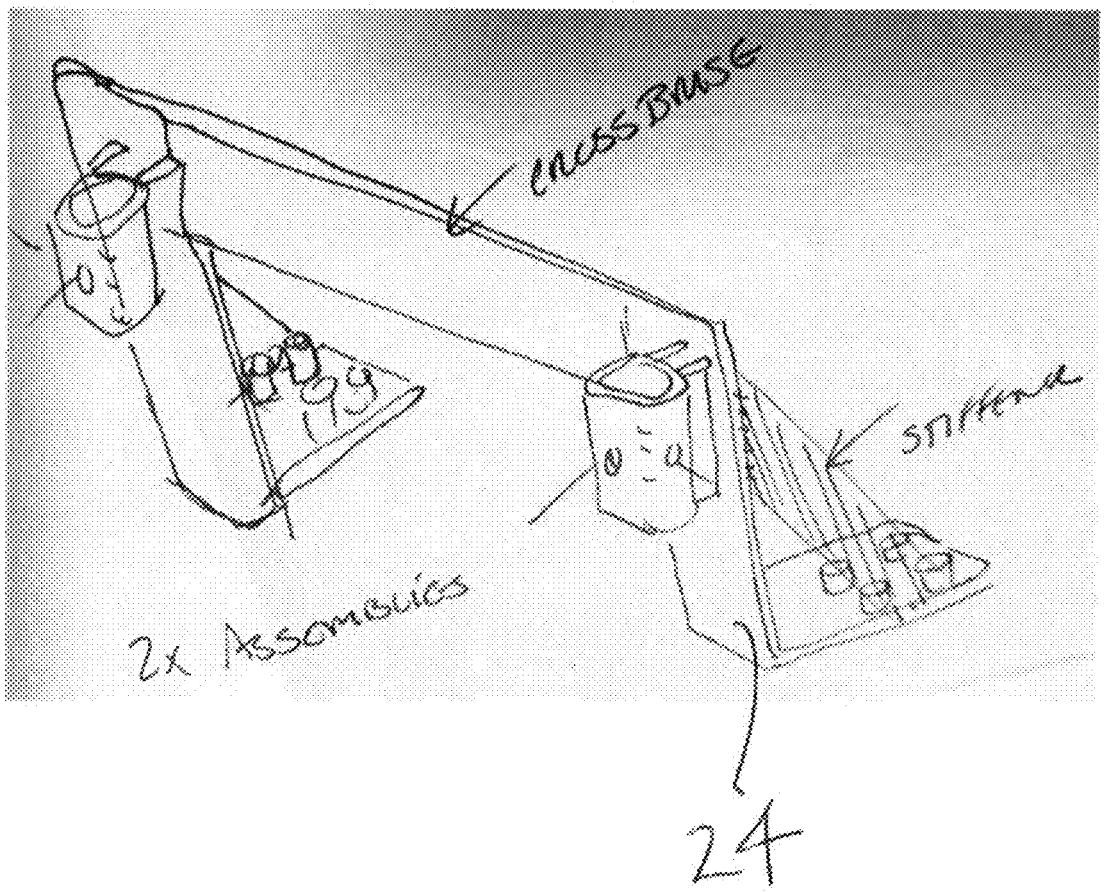
FIG. 6 illustrates a frame schematic that may be bolted to the base of the slicer unit in an example embodiment of the height adjustment attachments.

In an example embodiment of the invention, such as shown in FIGS. 5 and 5A, the slicer unit (10) is re-orientated, relative to the floor or surface (19) on which the apparatus (1) is arranged, by coupling a height adjustment attachment frame (24) to the base or a portion of the base of the apparatus (1) so that the apparatus (1) can be raised and/or lowered at at least some of the corners of the apparatus (1) in order to change the orientation of the slicer unit (10) relative to the floor (19) such that the slicing blade (14) is disposed at an angle relative to the horizontal floor. By using modified tooling and chute orientation, the food logs or slabs are presented to the slicing blade (14) at an angle relative to the slicing plane (17) of the slicing blade (14) within a range of approximately 13 to 90 degrees to the blade and axially between 0 and 180 degrees. As shown in FIGS. 5 and 5A, the apparatus (1) is configured such that the chute (12) is affixed to the slicer unit (10) such that the chute (12) is disposed at an angle (8) relative to the axis of rotation (15) of the slicing blade (14). By arranging the chute (12) at an angle relative to the axis of rotation of the cutting blade (14), the chute (12) is arranged relative to the cutting blade (14) (or cutting blade plane (17)) such that the central longitudinal axis of the chute (12) is disposed at a first angle, that is defined relative to the cutting blade (14) (or cutting blade plane (17)), wherein the first angle is within a range of approximately 13 to 90 degrees. The chute (12) is also affixed to the slicer unit (10) such that the chute (12) is disposed at second angle, relative to the cutting blade (14) (or cutting blade plane (17)), wherein the second angle is an angle of rotation of the chute (12) about the central longitudinal axis of the chute (12) that is between an angle greater than 0 and less than 180 degrees. Arranging the chute (12) at a second angle relative to the cutting blade (14) (or cutting blade plane (17)), wherein the chute (12) is rotated about its central longitudinal axis, is with effect that a reference edge defined by a cross-section of the chute (12), as taken along a plane that is transverse to the central longitudinal axis of the chute, is disposed at an angle relative to the cutting blade (14) (or cutting blade plane (17)) between an angle greater than 0 and less than 180 degrees, wherein the reference edge defined by the cross-section of the chute (12) would otherwise be disposed in a plane parallel to the cutting blade (14) (or cutting blade plane (17)) in the absence of any such rotation about the longitudinal axis of the chute (12) (e.g. relative to the square orientation). In a preferred example embodiment, a height adjustment frame (24) is positioned around the slicer unit (10) that allows the operator to raise and lower corners of the machine by as much as 18 inches at each corner. In an example, this increases the angle of the axis of rotation of the slicer blade (14), relative to floor (19), by 13% from the standard 90-degree angle. This change in orientation allows personnel to feed the fish slabs/logs (32) into the tooling (i.e. the chute (12)) at non-traditional angles, relative to the floor (19), and benefit from gravity assist. As described above, the chutes (12) are also arranged relative to the slicer unit (10) such that the longitudinal axis (20) of the chute (12) is disposed at an angle relative to the axis of rotation (15) of the slicer blade (14) with effect that the longitudinal axis of the chute (12) is disposed at a first angle relative to the cutting blade (14) or (cutting blade plane (17)). In this respect, the chute (12) is arranged relative to the slicer plane (17) of the slicer blade (14) at an angle that is less than the traditional 90 degree arrangement. The frame (24) is attached to slicing unit (10) by any suitable and known mechanical attachment, such as screws, rivets, clamps, bolts or any other suitable attachment to the base of the slicer unit. The embodiment of the frame (24) shown has height adjustable castors (26) that can be raised and lowered at each corner. As shown in the figures, particularly FIG. 5, the slicer unit (10) is tilted upwardly by the height adjustment frame (24) on the side (28) of the machine (1) where the chute inlets (16) are located (e.g. the side of the machine (1) where the longitudinal axis (20) of the chute (12) is disposed at an angle relative to the axis of rotation (15) of the slicer blade (14) in a clockwise direction as shown in FIG. 5). In FIG. 5*a* the slicer unit (10) is tilted upward on the side opposite of that shown in FIG. 5 with the orientation of chutes (12) being adjusted to the opposite side (29) of the apparatus (1) on the other side of the axis of rotation (15) of the slicer blade (14) (e.g. in a counter clockwise direction) and arranged on the same side as the conveyor 30 which allows for reduced personnel to operate the machine and possibly to accommodate commercially viable rates dependent of attributes of material being processed. Support frame (24) is positioned at the base of the slicing unit (10) with independent height adjustable castors (26) positioned at least at 2 adjacent corners of the unit, such as shown in FIGS. 5 and 5A. In the example shown, the frame and height adjustable casters are attached to the unit (10) at the side of the apparatus (1) where the chute inlets (16) are arranged, tilting the unit upwardly such that the blade angle to horizontal floor (19) is 13 degrees. It should be understood that the unit may be raised to a different angle.

In prior art methods and apparatus, the arrangement of the intake chutes (12) to the orbital slicing blade is vertical (i.e. 90 degrees to a horizontal cutting blade as is seen if FIG. 1) and vertical relative to the horizontal floor (19).

In the example embodiment of the herein invention shown in the drawing, the chute or chutes (12) are arranged relative to the slicer unit (10) such that the angle of the chute or chutes (12) to the cutting blade (14) itself (or to the cutting blade plane (17)) (e.g. the first angle of the chute (12)) is preferably 32 degrees. It is understood that this angle may range from between 15 to 90 degrees if desired. It was observed that arranging the chute (12) relative to the slicer unit (10) such that the chute (12) is disposed at a first angle relative to the cutting blade (14) of, preferably, 32 degrees in combination with a second angle, wherein the second angle is an angle of rotation of the chute (12) about the longitudinal axis (20) of the chute (12) of 22 degrees, such that the reference edge defined by a cross-section of the chute (12), as taken along a plane that is transverse to the central longitudinal axis of the chute, is disposed at an angle relative to the cutting blade (14) (or cutting blade plane (17)), was found to provide the dimensional shape specifications to emulate chicken wings in the finished cut pieces. As shown in FIGS. 7 and 8, in an example of the invention, each processed fish piece (40) portion is cut to be shaped to 14 to 19 g each, with a "6" sided beveled appearance. In some embodiments, for example, the rotation of the chute (12) about its longitudinal axis (20) is such that the chute outlet (18) is rotated relative to the slicing plane (17) of the cutting blade (14).

Utilizing the apparatus of the present invention, allows for creation from processed frozen fish or seafood a product that looks like and emulates the crisp texture and tenderness of like chicken wings—without the bones. From an example method and apparatus as will be discussed herein, a 6 sided, beveled shaped piece is formed that emulate the chicken wing appearance or other irregular non rectangular shapes. It should be understood that although frozen fish and seafood are specifically described, other blocks of frozen processed food or food that is not frozen and/or processed may be utilized with this machine, such as for example beef, pork, chicken, vegetables or other foods not specifically listed herein.

Block processed frozen fish, the raw material that is used to produce fish sticks and fish rectangle burgers is an example of the food to be used with the herein invention. An example apparatus for cutting blocks of frozen processed food into irregular shapes is shown in the figures, and in particular FIG. 5. A slicer unit (10) carries a horizontally oriented blade (14), wherein the slicer unit (10) is then tilted relative to the floor (19), by means of the height adjustment attachment (24), such that the previously horizontally oriented blade (14) is disposed at an angle relative to the floor (19), and includes at least one rectangular chute (12). In the example shown in FIG. 4, 6 chutes (12) are provided for feeding logs/slabs (32) (also referred to as blocks) of said frozen processed food to said blade (14) shown within the slicer unit (10) in schematic form. The chutes (10) define a chute path for said slabs/logs (32) extending from a chute inlet (16) to a chute outlet (18), the chute (12) having a central longitudinal axis (20) extending from the center of the chute inlet (16) to the center of chute outlet (18). The rotating cutting blade (14) is positioned below the chute outlets (18). Slabs/logs (32) of processed food are fed into each chute inlet (16) and pass through the chute (12) to the chute outlet (18) to the cutting blade (14). The blade divides the slabs/logs into smaller pieces (30) such as shown in FIGS. 7 and 8. As can be seen in FIG. 5, the chutes (12) are angled at 32 degrees to the blade (14) but in accordance with an aspect of the invention, the angle may be greater than 15 degrees and less than 90 degrees from the plane of the blade and preferably greater than 30 degrees and less than 80 degrees in an even further embodiment. The chutes (12) are also arranged relative to the cutting blade (14) such that they have been rotated axially about their longitudinal axis (20) (e.g. the second angle) between an angle greater than 0 to less than 180 degrees relative to a square orientation to the horizontal plane of the blade (14), for example as is shown in the prior art configuration of FIG. 1. In some embodiments, the chutes (12) are arranged relative to the cutting blade (14) such that they have been rotated about their longitudinal axis (20) by, preferably, 22 degrees. In the square orientation, the angle of rotation of the chute (12) about its central longitudinal axis (20) relative to the plane (17) of the cutting blade (14) is zero degrees such that an edge defined by the chute outlet (18), or a reference edge defined by a transverse cross-section of the rectangular chute (12), is disposed in a plane that extends parallel to the slicing plane (17) of the cutting blade (14). In the subject example embodiment, the chute (12) is arranged relative to the slicer unit (10) such that the chute (12) has been rotated about its central longitudinal axis (20) by an angle greater than 0 degrees to less than 180 degrees (e.g. a second angle, away from a square orientation) such that the chute (12) is arranged relative to the slicer unit (10) such that the edge defined by the chute outlet (18), or a reference edge defined by a transverse cross-section of the rectangular chute (12), is rotated out of the plane that is parallel to the plane (17) of the blade (14) by preferably 22 degrees. See for instance the rotation of the chute (12) and chute outlet (18) relative to the fixed plane 13 defined by the slicer unit (10) illustrated in FIG. 4. As described above, a height adjustment attachment such as a frame (24) with adjustable castors shown in FIG. 5/5A, raises the unit (10) at a chute inlet side (28) of the unit (10) such that the previously horizontal blade is raised to an angle of at least 13 degrees to the horizontal floor (19). In the embodiment shown in FIG. 5, the chute inlet side of the unit (10) is raised by 13 degrees to promote gravity feed.

It should be understood that although an array of 6 chutes (12) are present in the example apparatus any suitable orientation or amount of such chutes ranging from 1 to 8 or more could be utilized provided that they can be fit within the zone to feed to the machines fixed blade.

Figure 4:
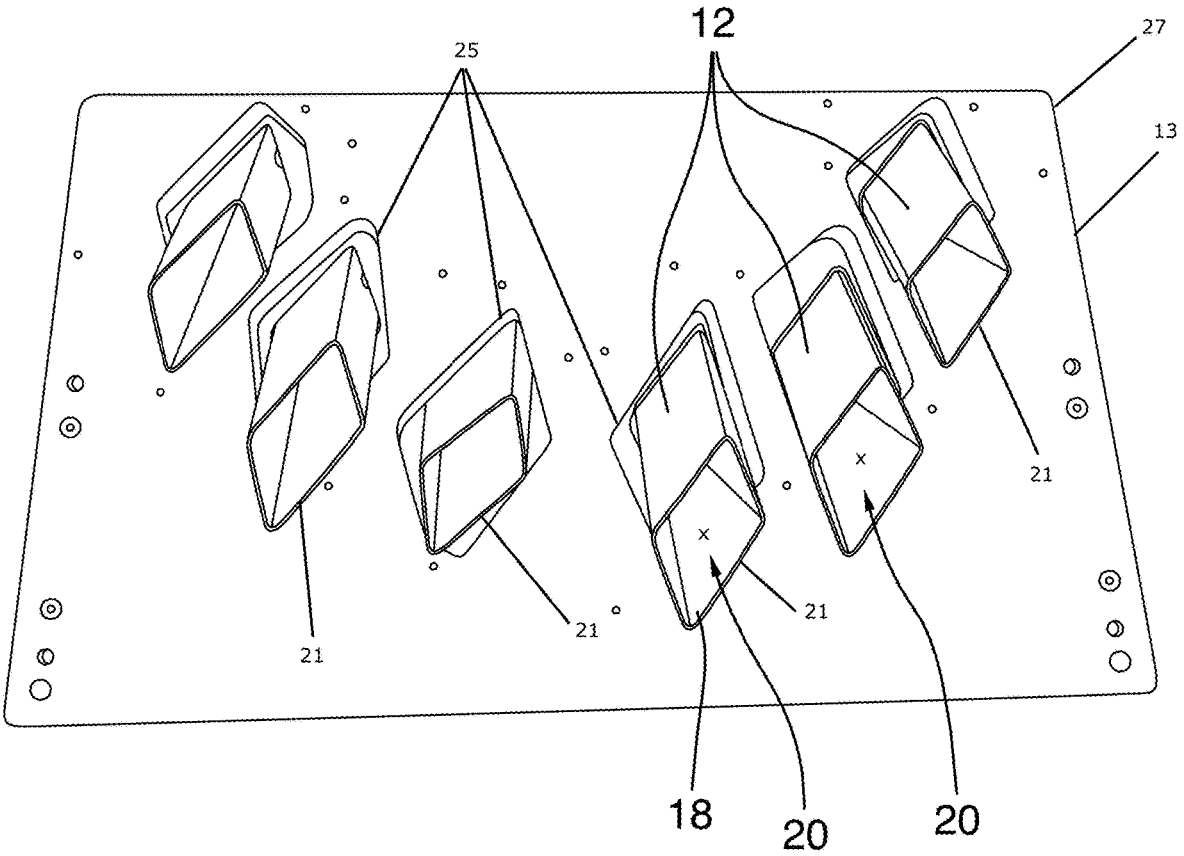
FIG. 4 is a bottom end view of chute outlet ends rotated about their longitudinal axis with the chute angle to blade being visible in accordance with an example embodiment of the invention.

As mentioned above, each rectangular chute is rotated around its central longitudinal axis (20) between an angle greater than 0 degrees and less than 180 degrees from the square orientation as described above. As described above, square is defined as a position of the chute (12) such that a reference plane of the chute (12), i.e. a plane that extends through at least one edge defined by the chute outlet (18) (or a reference edge defined by a cross-section of the chute (12) as taken along a plane that extends transverse to the central longitudinal axis (20)) is parallel to the plane of cutting blade, such as would be observed in prior art machines, for example, the prior art machine of FIG. 1 wherein the chute (12) is arranged vertically relative to the horizontally arranged blade (14) such that the chute (12) defines an outlet opening (having at least one edge) disposed in a plane that is parallel to the plane (17) of the blade (14). Arrangement of the chute (12) or chutes relative to the slicer unit (10) wherein the chute (12) has been rotated about its central longitudinal axis (2) away from the square orientation such that at least one edge (or a reference edge) is rotated out of the plane (17) of the blade (14), while the chute (12) is also disposed at an angle relative to the axis of rotation (15) of the blade such that the longitudinal axis of the chute (12) is disposed at an angle relative to the plane (17) of the cutting blade (14) (e.g. the first angle) creates a non-rectangular cut angle to the pieces of processed fish as they exit the chute outlet (18) and are cut by the blade (14). FIG. 4 shows a bottom view of chutes (12) (i.e. the chute outlets (18)) wherein the chutes (12) have been rotated about their respective central longitudinal axis (20) (marked schematically with an X in this figure) from the square orientation wherein the edges (21) of the chute outlet (18) would be parallel to the edges (23) that define the opening (25) within the cover plate (27) of the slicer unit (10) through which the chutes (12) extend towards the slicer blade (14) housed within the slicer unit (10), to the rotated orientation (as illustrated in FIG. 4) wherein the edges (21) of the chute outlet (18) are disposed at an angle relative to the edges (23) defined by the opening (25) in the cover plate (27), which is parallel to the plane (17) of the slicer blade (14).

As can be seen in FIG. 5, the chute Inlet (16) includes an extended log feeding landing section (34), extending from the chute beyond the inlet end, for placement of the log or logs (32) into the chute (12).

In an example of the invention, the angle of the chutes (12) to the horizontal plane of the floor surface (19) is at least 45 degrees. The angle of the rotating blade (14) to the horizontal plane of the floor surface (19) is 13 degrees.

Figure 2:
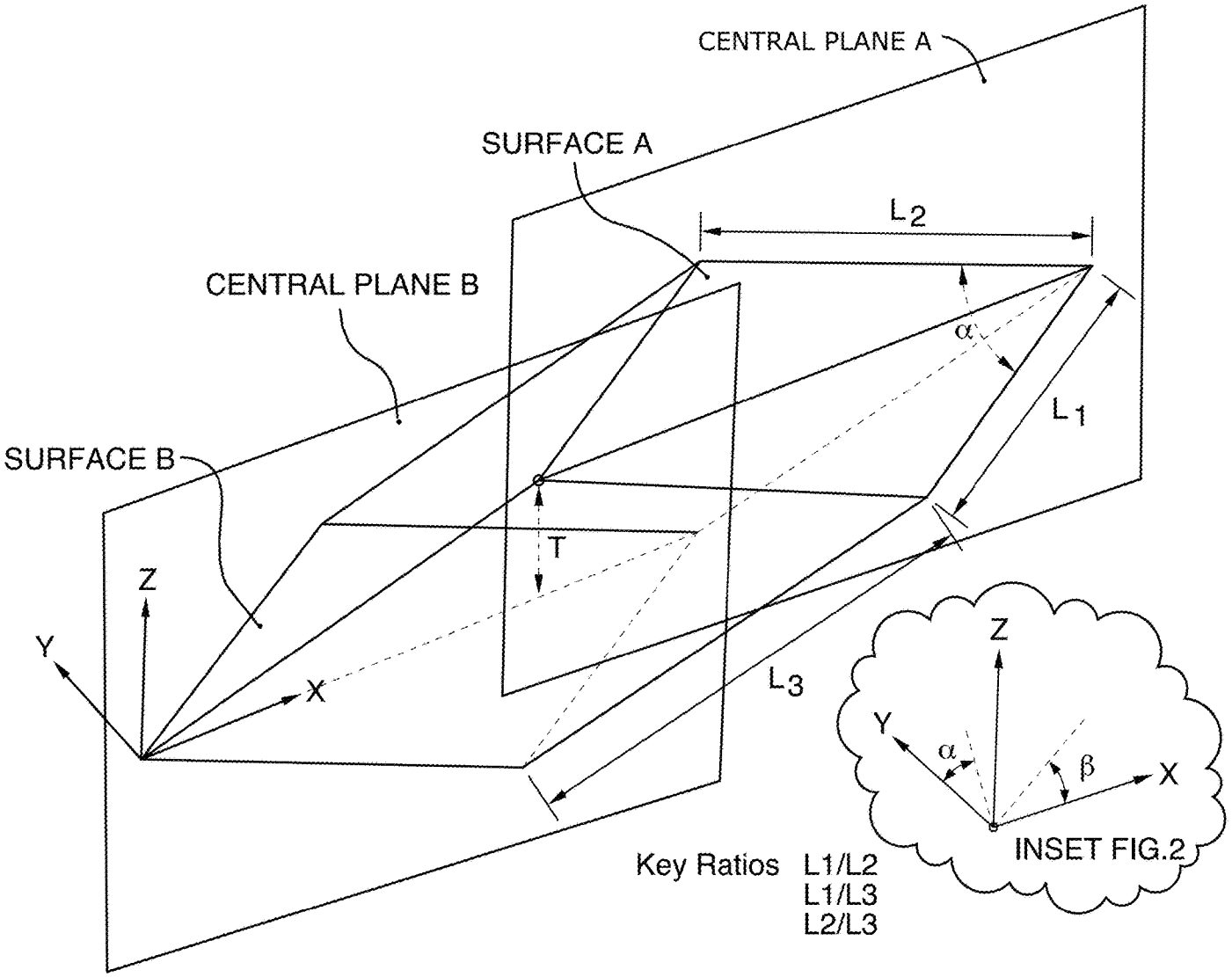
FIG. 2 is an example of fish shapes cut from the apparatus of the herein invention.
Figure 3:
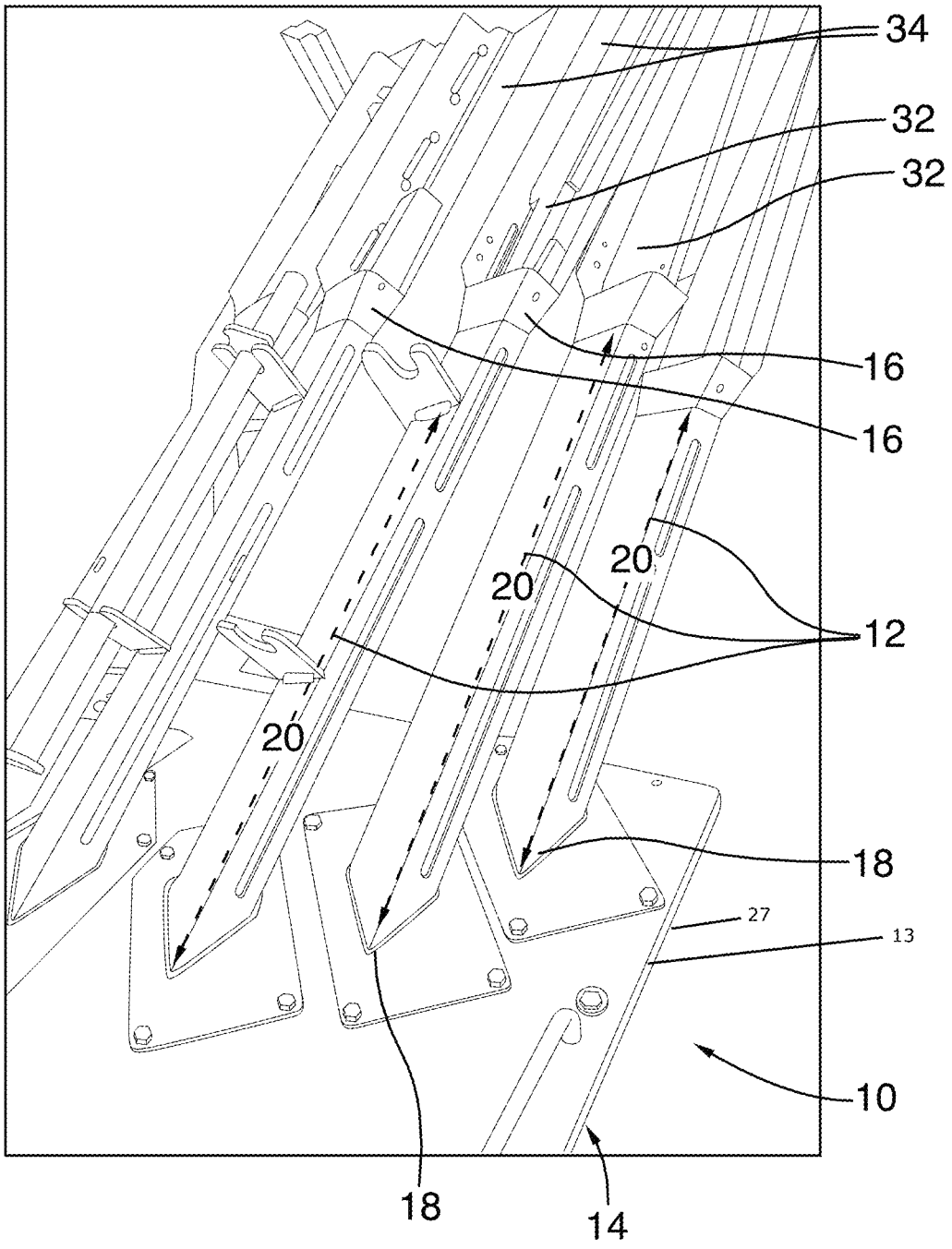
FIG. 3 shows a plurality of chutes attached to a standard orbital slicer in accordance with an example embodiment of the invention.

As illustrated in the drawings, FIG. 2 illustrates a preferred embodiment of the food product produced by the apparatus of the invention where the processed food wing shape is defined using the Cartesian coordinate system (x, y, z). The below described shape of food product is formed by the angles of the chute to blade, longitudinal rotation of the chute from the square orientation and the blade angle to the horizontal floor (19) as are described herein.

Surface A is a planar surface that has a parallelogram shape on an x-y plane. Surface B is a planar surface that has a parallelogram shape on an x-y plane. Dimension L1 is a distance on the x-y plane that defines two of the four edges of the parallelogram that defines each of Surface A and Surface B of the product shape. Dimension L2 is a distance on the x-y plane that defines the two other of the four edges of the parallelogram that defines each of Surface A and Surface B of the product shape. Dimension $\alpha$ (alpha) is an angle that defines the acute angle of each of parallelograms A & B. Dimension T is a distance in the z direction between the two product surfaces A and B. Surface B is located on a plane parallel to surface A. Surface B is of identical description to surface A.

A central plane is an imaginary surface necessary to define relative portions of each of surfaces A and B. The central plane intersects each one of surfaces A and B, independently, at the two opposite corners of these surfaces that are furthest apart. Both surface A and surface B each, independently, have unique central planes and these planes are perpendicular with the x-y plane.

Dimension B (beta) is an angle that defines the relationship of any identical coordinates x,y within surfaces A and B as a function of dimension T. This angle is relative to the x-axis on the x-z plane and when combined with Dimensions T defines the offset of the two parallelograms A and B in the x coordinate direction.

Dimension (gamma) is an angle that defines the relationship of any identical coordinates x.y within surfaces A and B as a function of T. This angle is relative to the y-axis on the x-y plane and when combined with dimension T, defines the offset of the two parallelograms in the y coordinate direction.

Dimension L3 is the distance that is dependent on variables L1, L2, T, B, and gamma.

The ratios, L1/L2, L1/L3, L2/L3 are important marketing values and create the unique appearance and eating experience. This is a level of geometric orientation not seen before in block cut food. The shape enhances the dining experience by presenting variable different types of texture and taste experience. The end tips are more crispy and crunchy, and somewhat drier than the middle of the product. The middle tends to be juicer and provide a more sumptuous eating experience.

The following sets out an example of a step by step method of how the frozen fish block is cut:

19"×10"×2.5" frozen Fish blocks are processed as follows:

10" dimension cut into longitudinal quarters, 10/4, creating 19"×2.5"×2.5" logs 2.5" dimension is cut into longitudinal quarters again 2.5/4, creating 19"×2.5"×0.625" slabs 2.5 dimension is cut in longitudinal half again 2.5/2, creating 19"×1.25"×0.625" rods These rods/logs (32) are fed into the feed chute landing sections (34) at the chute inlet (16). These logs (32) must be sized to fit for easy sliding fit through the chutes, but cannot be too small in cross section or they will rotate or spin as the blade cuts through it resulting in torn or uneven slices. In a preferred embodiment of the invention 4 logs of 19"×1.25"×0.625" are placed together in a chute (12) to create the desired size of food pieces. The blade cut location can be adjusted to adjust piece size as per known methods for cutting blades and orbital cutting blades.

In a preferred embodiment of the invention, conveyors take cut pieces from below the slicer for further processing.

In a preferred embodiment, the rectangular rods (32) (now cut to a length of 19"×1.25"×0.625") drop into 6 chutes (12) at a 32 degree to the orbital blade (14). Each chute has a longitudinal axis (20) extending from its chute inlet opening (16) to chute outlet (18). From one of its sides (or edges) of the chute outlet opening (18) being square to the cutting plane (17) of the cutting blade (14) (i.e. a plane extending through the at least one edge of the chute outlet opening (18) being parallel to the cutting plane (17) of the cutting blade (14)), the rectangular chute (12) is rotated between 20 to 80 degrees about its longitudinal axis (20). Rotation outside of this range may also be utilized between an angle greater than 0 degrees to an angle less than 180 degrees. In the subject example embodiment, each chute (12) is rectangular and matches the size and shape of the log or a plurality of rectangular logs (for example 4 said logs having a cross section of 2.5"×1.3") for a sliding fit between the plurality of rectangular logs and the interior passage defined by the chute (12).

As referred to above, in some embodiments, at the side of the apparatus (1) on which the chute inlets (16) are arranged which may vary between side (28) as shown in FIG. 5 and side 29 in FIG. 5A, the machine is titled upwardly at an additional 13 degrees such that the blade angle relative to the floor (19) is increased from horizontal (or parallel to the plane of the floor (19)) to 13 degrees relative to the plane of the floor (19). The upward tilt is achieved by means of the height adjustment support frame casters (26) described above. Other height adjustment means to raise the unit may be utilized as part of the invention, such as by hydraulic, electronic or other elevation support means.

In an example embodiment, the logs are cut into approximately 10 sections with a compound angle to create the final shape and weight, typically 14 to 19 grams. The resultant pieces are formed with 6 sides.

It is the angle in the rotation of chute (12) about its own axis in combination with the angle of chute to the plane (17) of the cutting blade (14) (wherein the cutting blade (14) is arranged between horizontal (or parallel to the floor (19)) to 13 degrees relative to the floor (19)), that creates the complex shape of cut pieces (40).

As seen in FIGS. 5 and 5*a*, angling the chutes from the typical vertical feeding in combination with their longitudinal rotation is required to create the fish wing shape. It is these two angles combined that generates the combined tapered shape—with 4 tapered sides which is unique in such cutting methods.

The present invention is novel and non-obvious over what others skilled in the art have done because the present method is not part of the standard operating procedure for using standard slicing machines. Cutting fish into chicken wing shapes of non uniform thickness was not an option using traditional methods.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention. It should be further understood that the figures may illustrate components of the invention and angles relating to said components in schematic form and may not be an accurate reflection of the dimensions and angles described in the specification. Any discrepancy between dimensions and angles shown in the figures and described in the specification shall be resolved in favour of that described in the specification.

The invention claimed is:

1. An apparatus for cutting blocks of food into irregular shapes comprising:

a slicer unit including a cutting blade defining a cutting blade plane, the cutting blade being disposed for rotation about an axis that extends perpendicular to the cutting blade plane; and at least one chute for feeding logs of food to said cutting blade, each one of the at least one chute, independently, defining a chute path for said logs extending from a chute inlet to a chute outlet wherein said logs are discharged from a respective one of the at least one chute to the cutting blade for sectioning into smaller pieces, each one of the at least one chute, independently, having a central longitudinal axis extending from the center of the chute inlet to the center of the chute outlet and a rectangular cross-section as taken along a plane that extends transverse to the central longitudinal axis;

wherein:

said cutting blade is positioned below the chute outlet of each one of the at least one chute; and each one of said at least one chute, independently, is affixed relative to the slicer unit such that each one of the at least one chute, independently, is disposed:

(i) at a first angle, relative to the cutting blade plane, of greater than 15 degrees and less than 90 degrees, wherein the first angle is defined between the central longitudinal axis of a respective one of the at least one chute and the cutting blade plane; and (ii) at a second angle of greater than 0 degrees and less than 180 degrees, wherein the second angle is an angle of rotation of the respective one of the at least one chute about the central longitudinal axis.

2. The apparatus as claimed in claim 1 further comprising: a height adjustment attachment coupled to the slicer unit, wherein the height adjustment attachment frame is configured for raising said slicer unit, relative to a floor surface on which the apparatus is disposed, at at least 2 adjacent corners thereof.

3. The apparatus as claimed in claim 2, wherein the height adjustment attachment is configured such that the slicer unit is raised relative to the floor surface at the chute inlet side of the apparatus by a slicer unit height adjustment angle with effect that the central longitudinal axis of the at least one rectangular chute is disposed at an angle relative to the floor surface of at least 45 degrees.

4. The apparatus as claimed in claim 2 wherein the height adjustment attachment include:

a height adjustment support frame secured to a base of the slicer unit; and height adjustable castors coupled to the height adjustment support frame such that while the height adjustment support frame is coupled to the slicer unit, a height adjustable castor is positioned at at least 2 adjacent corners of the slicer unit.

5. The apparatus as recited in claim 4, wherein the apparatus is disposed on a surface, and the height adjustable castors are adjusted such that a chute inlet side of the slicer unit is raised relative to the plane of the surface on which the apparatus is disposed by at least 13 degrees.

6. The apparatus as recited in claim 2 wherein the height adjustment attachment is configured such that the slicer unit is raised relative to the floor surface at the chute inlet side of the apparatus by a slicer unit height adjustment angle such that the first angle and the slicer unit height adjustment angle, together, total at least 45 degrees.

7. The apparatus as recited in claim 2 wherein the height adjustment attachment is configured such that the slicer unit is raised relative to the floor surface such that, while the slicer unit is operating and logs of a fish product are fed into a respective one of the at least one chute, the apparatus generates individual fish portions from the logs of the fish product wherein each individual fish portion, independently, is a six-sided fish portion weighing a minimum of 14 g and a maximum of 19 g.

8. The apparatus as claimed in claim 2 wherein of the at least one chute, independently, is configured for receiving and transmitting rectangular-shaped food logs from the chute inlet to the chute outlet wherein the rectangular logs are 19"×1.25"×0.62" in shape and are transmitted by the chute from the chute inlet to the chute outlet in a sliding fit relationship.

9. The apparatus as claimed in claim 1, wherein the at least one chute includes 4, 6 or 8 of said chutes.

10. The apparatus as claimed in claim 1 wherein the logs are comprised of frozen processed seafood or fish.

11. The apparatus as claimed in claim 1 wherein each one of the at least one chute, independently, is configured for receiving the logs in a sliding fit arrangement such that sliding of the logs within a respective one of the at least one chute along the chute path is permitted.

12. The apparatus as recited in claim 1 wherein each one of the at least one chute, independently, includes an extended log landing section, extending away from a bottom edge surface of the chute inlet along an axis that extends parallel to the central longitudinal axis of the chute, the extended log landing section configured for receiving placement of the log or logs for entry into the chute via the chute inlet.

13. The apparatus of claim 1 wherein each one of the at least one chute, independently, is affixed to the slicer unit such that the central longitudinal axis is disposed at an angle of 32 degrees relative to the cutting blade.

14. The apparatus as claimed in claim 1 wherein each one of the at least one chute, independently, is configured for receiving and transmitting rectangular-shaped food logs from the chute inlet to the chute outlet wherein each of said food logs includes 4 longitudinal precut feed logs that are stacked together such that the stacked precut feed logs, together, have a cross-sectional shape that corresponds to the cross-sectional shape of a respective one of the at least one chute such that the 4 longitudinal precut feed logs are transmitted through the chute from the chute inlet to the chute outlet simultaneously in a sliding fit relationship.

15. The apparatus as claimed in claim 14 wherein each one of the 4 longitudinal precut feed logs has a rectangular shape of 19"×1.25"×0.625".

16. The apparatus as claimed in claim 1 wherein each one of the at least one chute, independently, is affixed to the slicer unity such that (i) the first angle is 32 degrees; and (ii) the second angle is 22 degrees.

* * * * *